US009975346B2

(12) United States Patent
Amma et al.

(10) Patent No.: US 9,975,346 B2
(45) Date of Patent: May 22, 2018

(54) LIQUID EJECTION HEAD, LIQUID EJECTION APPARATUS AND MANUFACTURING METHOD FOR LIQUID EJECTION HEAD

(71) Applicant: CANON KABUSHIKI KAISHA, Tokyo (JP)

(72) Inventors: Hiromasa Amma, Kawasaki (JP); Mikiya Umeyama, Tokyo (JP); Genji Inada, Koshigaya (JP); Takuya Iwano, Inagi (JP); Yasuyuki Takanaka, Yokohama (JP); Masaya Uetsuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/155,630

(22) Filed: May 16, 2016

(65) Prior Publication Data

US 2016/0347077 A1 Dec. 1, 2016

(30) Foreign Application Priority Data

May 29, 2015 (JP) ..... 2015-110246

(51) Int. Cl.
*B41J 2/175* (2006.01)
*B41J 29/02* (2006.01)

(52) U.S. Cl.
CPC ..... *B41J 2/17513* (2013.01); *B41J 2/1752* (2013.01); *B41J 2/17553* (2013.01); *B41J 29/02* (2013.01); *B41J 2/17563* (2013.01)

(58) Field of Classification Search
CPC ..... B41J 2/1404; B41J 2/14145; B41J 2002/14403; B41J 2202/11
See application file for complete search history.

(56) References Cited

U.S. PATENT DOCUMENTS 5,812,165 A * 9/1998 Boyd ..... B41J 2/19 347/87
5,917,527 A * 6/1999 Boyd ..... B41J 2/17513 347/85
6,095,639 A 8/2000 Uetsuki et al.
(Continued)

FOREIGN PATENT DOCUMENTS

JP 2002-307709 A 10/2002

OTHER PUBLICATIONS

U.S. Appl. No. 15/151,964, Genji Inada, Hiromasa Amma, Takuya Iwano, Chiaki Muraoka, Tokuji Kudo, Shimpei Yoshikawa, filed May 11, 2016.

(Continued)

*Primary Examiner* — Stephen Meier
*Assistant Examiner* — John P Zimmermann
(74) *Attorney, Agent, or Firm* — Fitzpatrick, Cella, Harper & Scinto

(57) ABSTRACT

Provided are a liquid ejection head, a liquid ejection apparatus and a manufacturing method for the liquid ejection head which make it possible to achieve both of high-speed printing and a reduction in number of recovering operations. A liquid chamber which is formed in a part of a flow passage that guides liquid to an ejection element substrate includes plural supply paths which are able to supply the liquid by capillarity, are connected together and are different from one another in width.

7 Claims, 7 Drawing Sheets

(56) References Cited

U.S. PATENT DOCUMENTS

| | | | | |
|---|---|---|---|---|
| 6,158,855 | A * | 12/2000 | Saikawa | B41J 2/17513 347/92 |
| 6,467,882 | B2 | 10/2002 | Inui et al. | |
| 6,540,343 | B1 | 4/2003 | Umeyama et al. | |
| 6,749,296 | B2 * | 6/2004 | Usui | B41J 2/175 347/93 |
| 6,805,437 | B2 | 10/2004 | Yamanaka et al. | |
| 7,273,275 | B2 * | 9/2007 | Buchanan | B41J 2/17513 347/87 |
| 7,537,318 | B2 * | 5/2009 | Fujii | B41J 2/17513 347/66 |
| 8,087,759 | B2 | 1/2012 | Oikawa et al. | |
| 8,210,655 | B2 | 7/2012 | Muraoka et al. | |
| 8,998,375 | B2 | 4/2015 | Amma et al. | |
| 9,248,650 | B2 | 2/2016 | Muraoka et al. | |
| 2003/0043240 | A1 * | 3/2003 | Dowell | B41J 2/17509 347/85 |
| 2010/0255616 | A1 * | 10/2010 | Kokubo | B41J 2/1603 438/21 |

OTHER PUBLICATIONS

U.S. Appl. No. 15/160,167, Genji Inada, Hiromasa Amma, Takuya Iwano, Chiaki Muraoka, Tokuji Kudo, Shimpei Yoshikawa, Monta Matsui, filed May 20, 2016.

* cited by examiner

LIQUID EJECTION HEAD, LIQUID EJECTION APPARATUS AND MANUFACTURING METHOD FOR LIQUID EJECTION HEAD

BACKGROUND OF THE INVENTION

Field of the Invention

The present invention relates to a liquid ejection head to be mounted on a liquid ejection apparatus, the liquid ejection apparatus and a manufacturing method for the liquid ejection head.

Description of the Related Art

In the liquid ejection head configured to eject liquid through an ejection port, in general, a recovering operation for removing a thickening substance of the liquid (also, referred to as ink) and accumulated air bubbles in the liquid ejection head by suctioning the thickening substance and the air bubbles through the ejection port is performed in order to maintain a favorable ejection state. On this occasion, the ink which is contained in a liquid chamber in the liquid ejection head is also suctioned and discharged from the ejection port in order to surely discharge the thickening substance and the accumulated air bubbles.

In a liquid ejection head used in a printing apparatus, there exists a liquid ejection head for large size printing which is adapted for large size printing by increasing the number of the ejection ports. The amount of the ink to be discharged in the recovering operation is increased with increasing the number of the ejection ports. Therefore, it is necessary to contain much ink by increasing the capacity of the liquid chamber of the liquid ejection head.

On the other hand, also the number of the air bubbles generated during a printing operation is inevitably increased with increasing the number of the ejection ports. Since some of the air bubbles are accumulated in the liquid chamber, it is necessary to increase the capacity of the liquid chamber also in order to accumulate a certain amount of the generated air bubbles in the liquid chamber. It becomes possible to reduce the number of the recovering operations by the liquid chamber which has the capacity sufficient for accumulation of the air bubbles.

In Japanese Patent Laid-Open No. 2002-307709, two liquid chambers, that is, a first liquid chamber and a second liquid chamber are arranged in a liquid ejection head, with a filter interposed therebetween for preventing foreign matters in the ink and the air bubbles from entering the ejection port, and a liquid chamber groove structure is provided in the second liquid chamber located on the ejection port side so as to enable communication of the liquid between the first liquid chamber and the second liquid chamber with the filter being interposed therebetween.

In general, in a serial scan type liquid ejection head, an ejection element substrate which includes the ejection port for ejecting the ink is configured compactly for cost saving. Therefore, the liquid chamber which is provided in a flow passage which supplies the liquid to the election element substrate is configured such that the width in a scanning direction is gradually narrowed as it approaches the ejection port. Thereby, it becomes possible to further narrow down a scanning range of the liquid ejection head relative to a scanning-direction width of a printing medium and higher speed printing becomes possible.

Accordingly, in order to achieve both of high speed printing and a reduction in number of the recovering operations, it is necessary to narrow the scanning-direction width of the liquid chamber while increasing the capacity of the liquid chamber in the liquid ejection head. Therefore, it is demanded to configure the liquid chamber so as to be large in a height direction.

Here, in general, a housing which configures the liquid chamber in Japanese Patent Laid-Open No. 2002-307709 is fabricated by molding. A liquid chamber groove structure of the second liquid chamber in FIG. 10 in Japanese Patent Laid-Open No. 2002-307709 is formed by a die to be removed toward the filter side after molding. It is necessary to provide a draft angle to the die. However, in a case where the draft angle is provided to the liquid chamber groove structure leads, a width of a groove on the ejection port side becomes narrower than a width of the groove on the filter side.

In a case where the liquid chamber is to be configured to be narrow in the scanning direction and to be large in the height direction, it is necessary to set meniscus force of the groove higher, that is, to set the width of the groove narrow. However, in a case where the liquid chamber is made large in the height direction in a configuration which includes the liquid chamber groove structure in Japanese Patent Laid-Open No. 2002-307709, the groove on the ejection port side becomes too narrow due to provision of the draft angle and thus it becomes difficult to provide the draft angle. Accordingly, in the configuration in Japanese Patent Laid-Open No. 2002-307709, although high speed printing is possible, it becomes difficult to make the liquid chamber large in the height direction and therefore it becomes also difficult to reduce the number of the recovering operations.

SUMMARY OF THE INVENTION

Accordingly, the present invention aims to provide a liquid ejection head, a liquid ejection apparatus and a manufacturing method for the liquid ejection head which make it possible to achieve both of the high-speed printing and the reduction in the number of recovering operations.

According to the present invention, there is provided a liquid ejection head including an ejection element substrate configured to eject liquid, and a liquid chamber which is formed in a part of a flow passage that guides the liquid to the ejection element substrate, the liquid chamber being formed in a part of a housing formed by molding, wherein the liquid chamber includes a plurality of supply paths which enables communication between the upstream and the downstream of the flow passage, is able to supply the liquid by capillarity, is connected together and is different from one another in width, and in the plurality of supply paths, the supply path which is located at a higher position in a vertical direction in a posture taken in use has a stronger capillary force.

According to the present invention, it is possible to realize the liquid ejection head, the liquid ejection apparatus and the manufacturing method for the liquid ejection head which make it possible to achieve both of the high speed printing and the reduction in the number of recovering operations.

Further features of the present invention will become apparent from the following description of exemplary embodiments (with reference to the attached drawings).

DESCRIPTION OF THE EMBODIMENTS

In the following, an embodiment of the present invention will be described with reference to the drawings.

Figure 1:
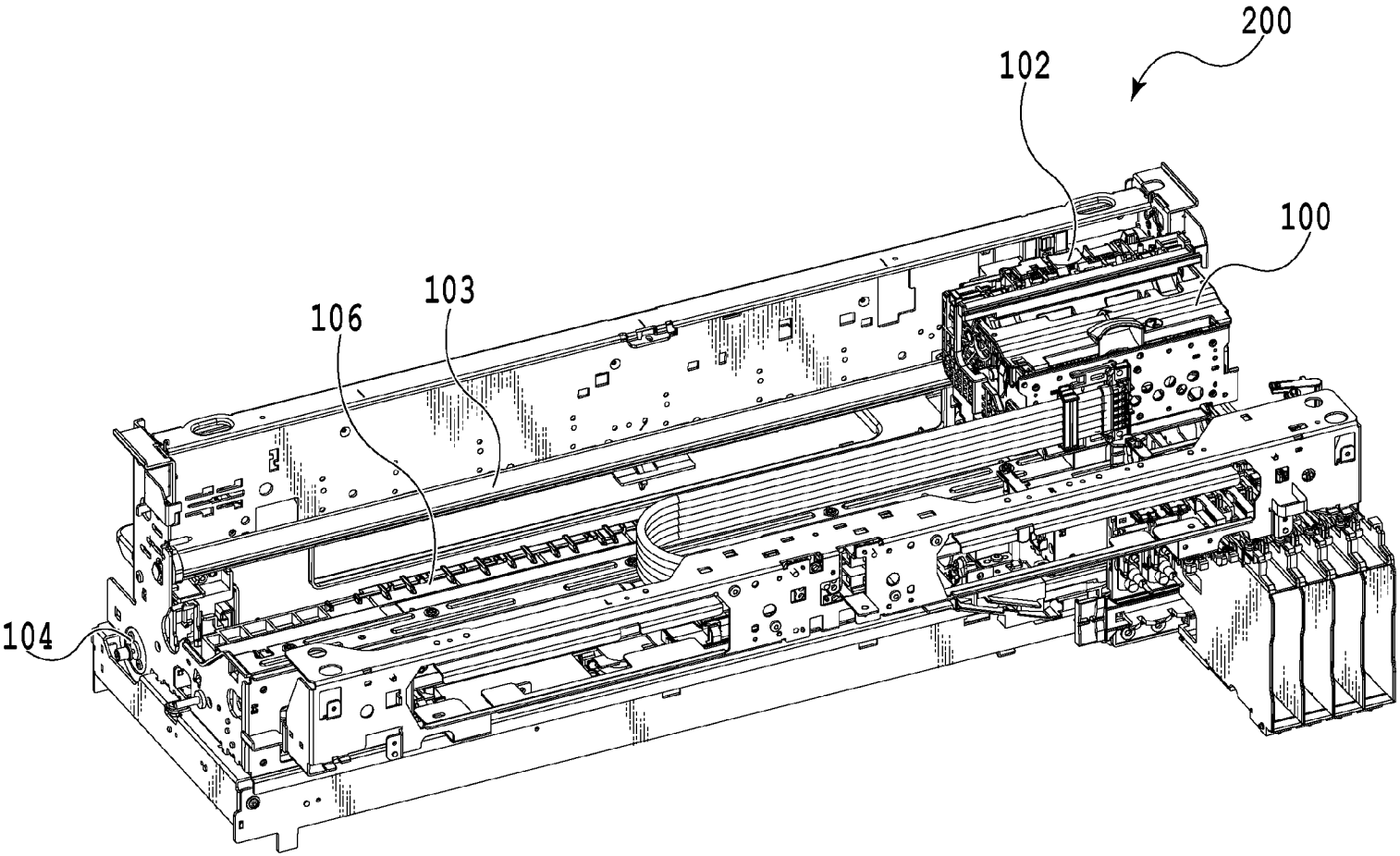
FIG. 1 is a perspective view illustrating a liquid ejection apparatus.

FIG. 1 is a perspective view illustrating a liquid ejection apparatus 200 to which the present embodiment is applicable. A carriage 102 on which a liquid ejection head is to be mounted is supported to be reciprocally movable along a guide 103 which is extended along a main scanning direction. The carriage 102 to which a liquid supply tube is connected is driven by a carriage motor (not illustrated).

A printing medium such as a sheet of paper is fed by a feed roller (not illustrated) which is driven by a feed motor (not illustrated) of a sheet feed mechanism via a gear train and is sent out onto a platen 106 by a conveying roller 104 and a pinch roller (not illustrated). Liquid is ejected through an ejection port of a liquid ejection head onto the printing medium which is conveyed on the platen 106 by the conveying roller 104 and a discharge roller (not illustrated) and thereby printing is performed on the printing medium.

In a case of performing printing on the printing medium, the carriage 102 is accelerated from a stopped state, and thereafter moved at a constant speed throughout a scanning range for a printing operation. On this occasion, the liquid is ejected through the ejection port of the liquid ejection head 100 onto the printing medium to form an image on the printing medium. After printing for one line has been completed by performing scanning one time or a plurality of times, the carriage 102 is decelerated and stops. Then, the printing medium is fed by a predetermined amount by rotation of the conveying roller 104 and the discharge roller.

Figure 2:
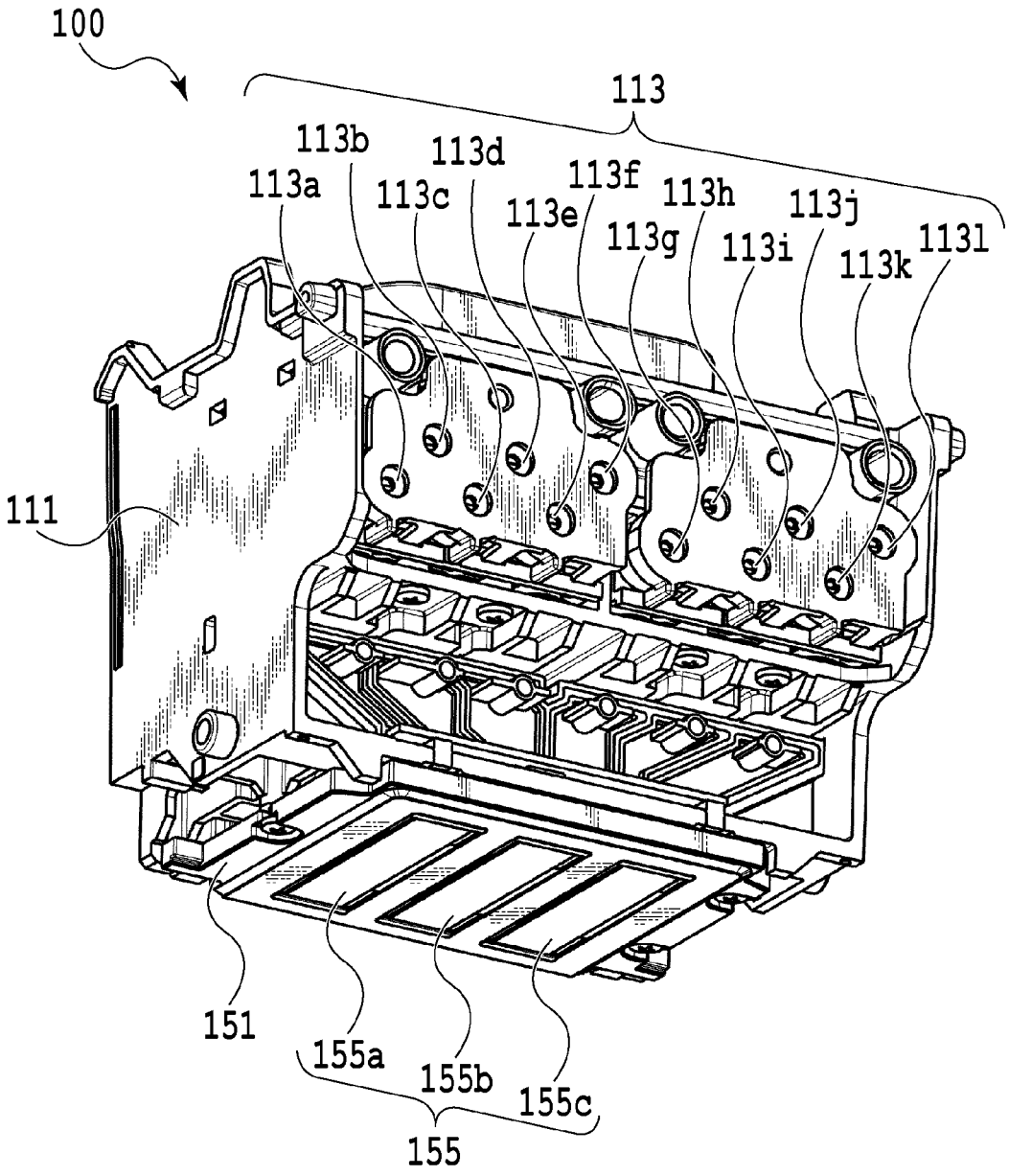
FIG. 2 is a perspective view illustrating a liquid ejection head.
Figure 3:
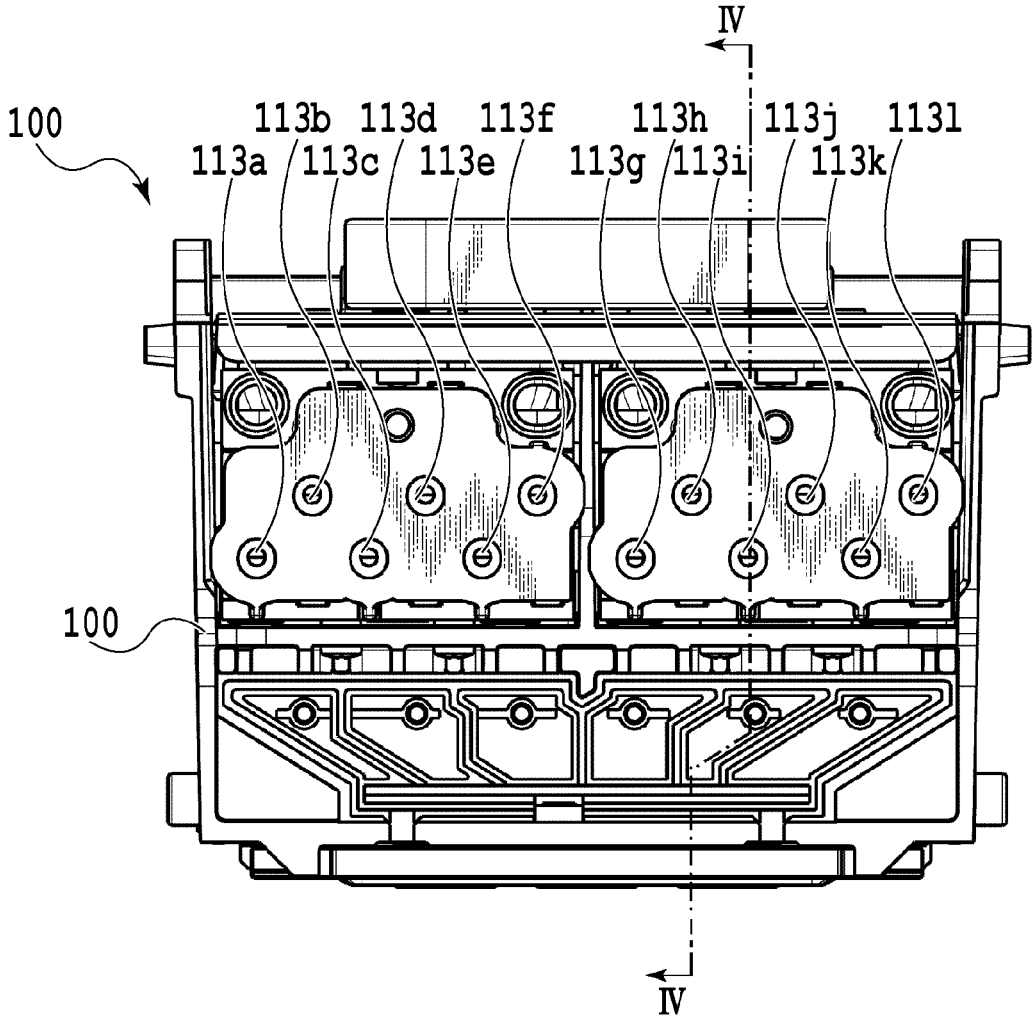
FIG. 3 is a plan view illustrating the liquid ejection head.

FIG. 2 is a perspective view illustrating the liquid ejection head 100 according to the present embodiment. FIG. 3 is a plan view illustrating the liquid ejection head 100. The liquid ejection head 100 is fixedly supported on the carriage by a positioning unit of the carriage and an electric contact provided in the liquid ejection apparatus (not illustrated) and is made detachable relative to the carriage.

The liquid ejection apparatus includes an ink supply tube (not illustrated) connected with an ink tank (not illustrated) and a liquid connector is provided on a leading end of the ink supply tube. In a case where the liquid ejection head 100 is mounted on the carriage, the liquid connector and a liquid connector insertion port 113 are air-tightly connected together and the ink in the ink tank is supplied to the liquid ejection head.

The liquid ejection head 100 according to the present embodiment is a liquid ejection head capable of ejecting twelve kinds of inks, liquid connector insertion ports 113*a* to 113*l* are provided respectively corresponding to the respective liquid supply tubes and supply paths are individually formed.

Figure 4:
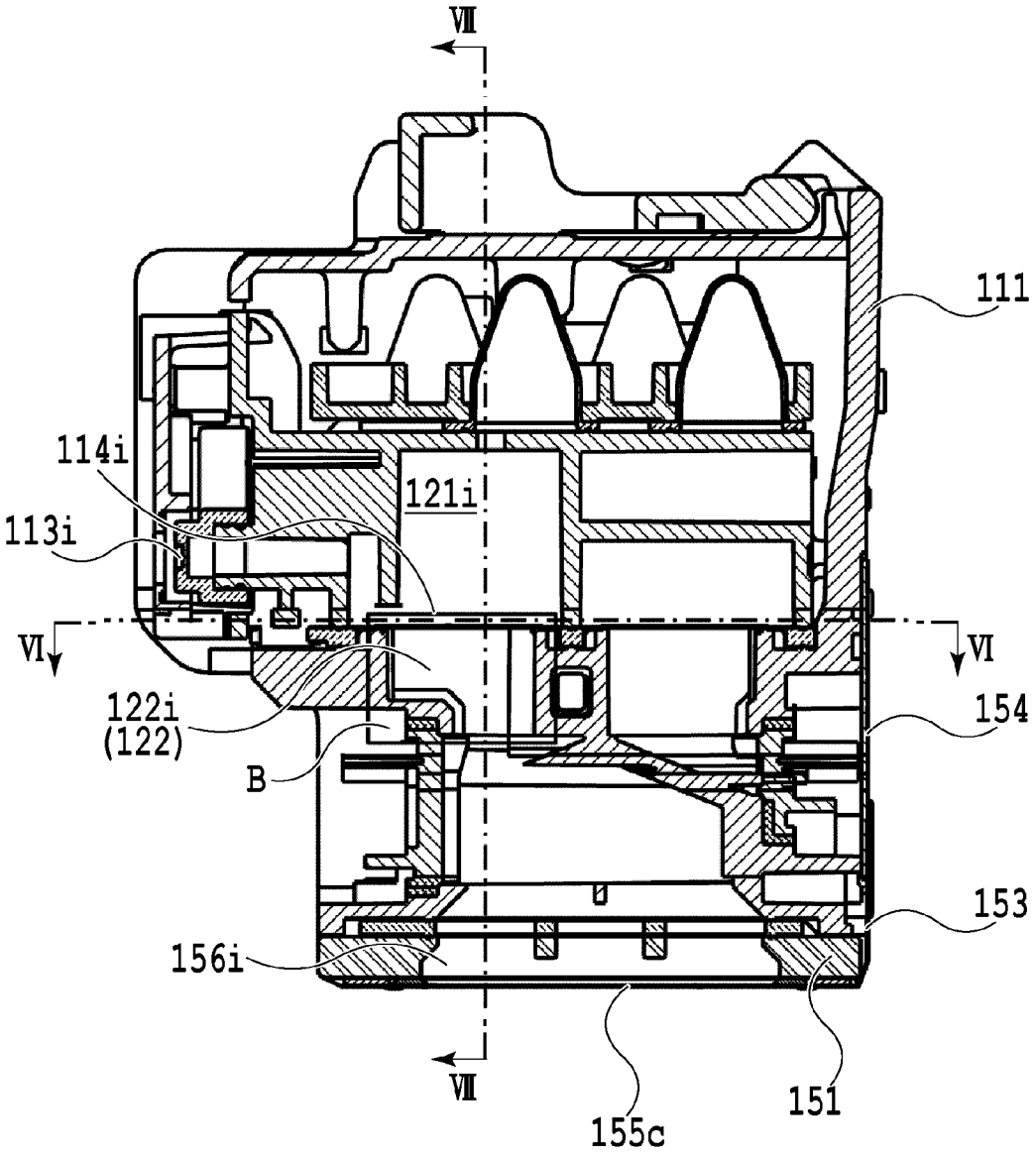
FIG. 4 is a sectional diagram illustrating an ink supply path from a liquid connector insertion port to an ejection element substrate.

FIG. 4 is a sectional diagram along a IV-IV line in FIG. 3, illustrating a supply path of an ink from the liquid connector insertion port 113*i* to an ejection element substrate 155. Although, in the following, the supply path of the ink from the liquid connector insertion port 113*i* to the ejection element substrate 155 will be described, other supply paths of the inks from other liquid connector insertion ports to the ejection element substrate 155 have the same configuration as the above.

The ink which has been supplied from the liquid connector insertion port 113*i* flows from a first liquid chamber 121*i* through a filter 114*i* which prevents a foreign substance from mixing into an ejection element substrate 155*c* and is supplied to the ejection element substrate 155*c* through a second liquid chamber 122*i*. That is, the filter 114*i* is provided on an upstream end of the second liquid chamber 122*i*. The second liquid chamber 122*i* is formed in a housing 111 which is a molded component. In addition, an ejection port (not illustrated) is formed in the ejection element substrate 155*c* and the ink supplied from the second liquid chamber 122*i* is ejected through the ejection port.

Ejection element substrates 155*a* to 155*c* each include a substrate made of silicon (hereinafter, referred to as a silicon substrate) of 0.5 to 1 mm in thickness and an energy generation element which is provided on one surface of the silicon substrate and generates energy utilized for ejecting the liquid. In the present embodiment, a plurality of heating resistance elements (heaters) is used as the energy generation element and an electric wiring which supplies electric power to each heating resistance element is formed on each silicon substrate by a film-deposition technology.

A plurality of ink flow passages which corresponds to the heating resistance elements and the plurality of ejection ports for ejecting the inks are formed in each silicon substrate by a photolithographic technology. Ink supply ports which supply the inks to the plurality of ink flow passages are opened to a back surface of the silicon substrate.

The ejection element substrates 155*a* to 155*c* are adhesively fixed to a first support member 151. Twelve ink supply ports are formed in the first support member 151 and are respectively connected to the second liquid chambers corresponding to colors of the respective inks. An electric wiring member 153 is held so as to be electrically connected to the ejection element substrate 155. The electric wiring member 153 applies electric signals for ejecting the inks to the ejection element substrates 155*a* to 155*c*.

An electric connection part between each of the ejection element substrates 155*a* to 155*c* and the electric wiring member 153 is sealed with a sealing material so as to be protected from ink-induced corrosion and external impacts. An electric contact substrate 154 is thermally crimped and electrically connected to an end of the electric wiring member 153 by using an anisotropic electro-conductive film (not illustrated). The electric contact substrate 154 includes an external signal input terminal for receiving the electric signal from an inkjet recording apparatus.

Figure 5:
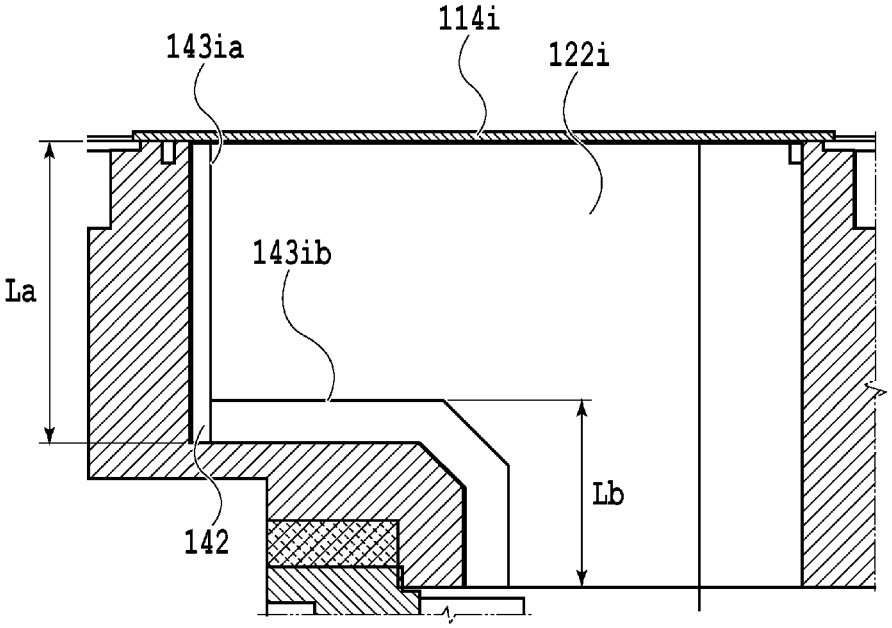
FIG. 5 is a detailed diagram illustrating a part B in FIG. 4.
Figure 6:
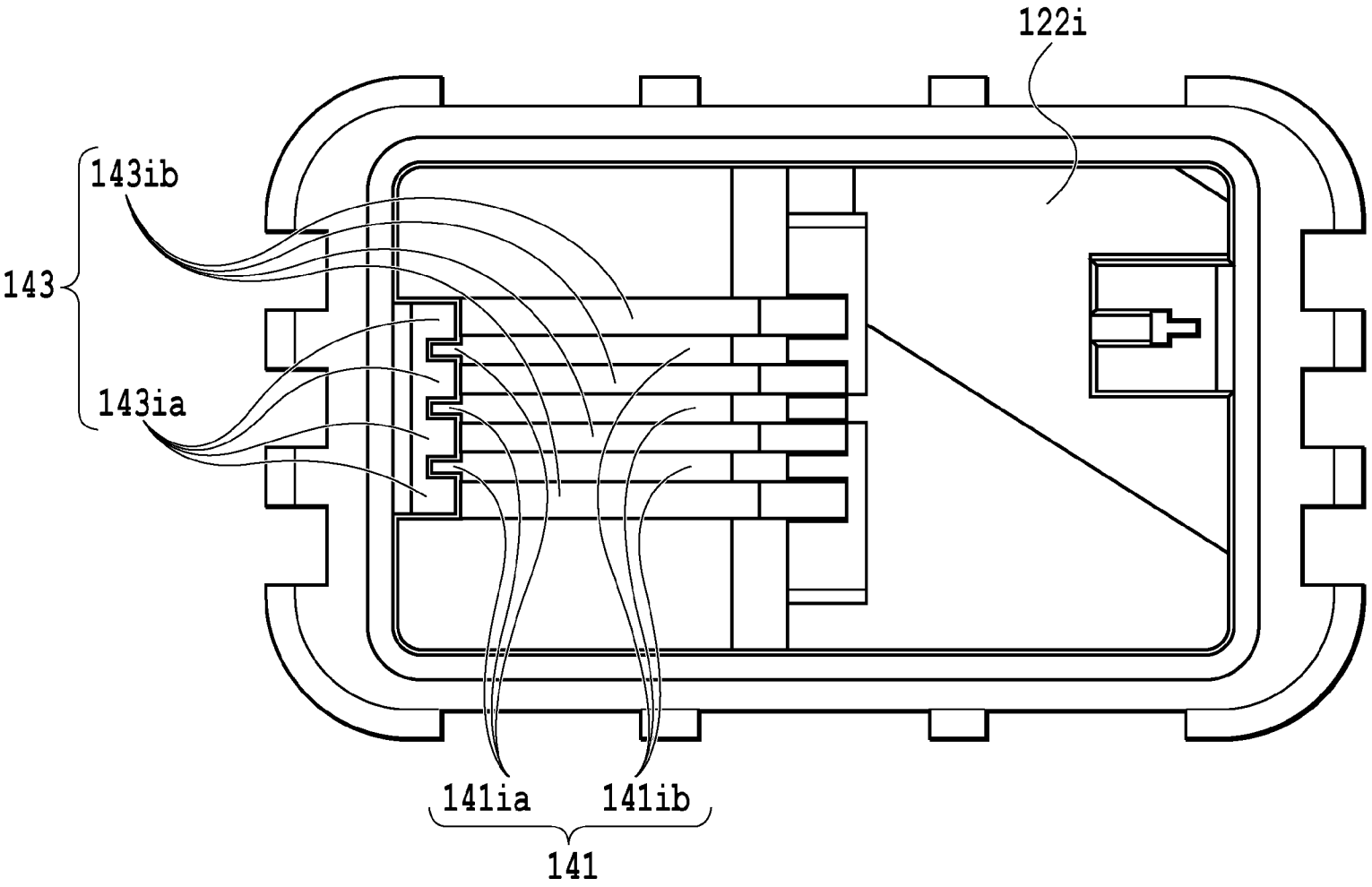
FIG. 6 is a sectional diagram along a VI-VI line in FIG. 4.
Figure 7:
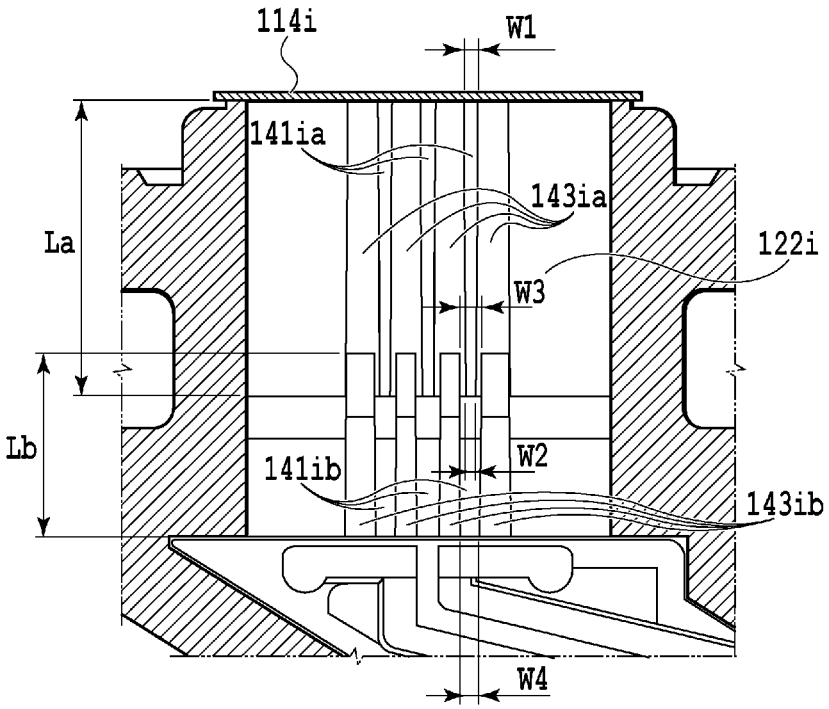
FIG. 7 is a sectional diagram along a VII-VII line with a filter being removed in FIG. 4.

FIG. 5 is a detailed diagram illustrating a part B in FIG. 4. FIG. 6 is a sectional diagram along a VI-VI line in FIG. 4. FIG. 7 is a sectional diagram along a VII-VII line with the filter 114*i* being removed in FIG. 4.

Next, the second liquid chamber 122 (122*i*) and a supply path 141 which are characteristic constitutional elements of the present invention and are formed in the housing 111 formed by molding will be described in detail. As illustrated in FIG. 5 to FIG. 7, every four ribs 143 (143*ia* and 143*ib*) which project from an inner wall which forms the second liquid chamber 122*i* are arranged in the second liquid chamber 122*i* and are bent by about 90 degrees at a bent part 142. In addition, the ribs 143*ia* and 143*ib* are arranged so as to form supply paths 141*ia* and 141*ib* in grooved regions which are respectively formed between the mutually juxtaposed and adjacent ribs 143*ia* and between the mutually juxtaposed and adjacent ribs 143*ib*.

The supply paths 141*ia* and 141*ib* enable communication between the upstream side and the downstream side of the second liquid chamber 122*i*. The ink on the downstream side of the second liquid chamber 122 is drawn up to the filter 114*i* located on its upstream side with the aid of capillary forces of the supply paths 141*ia* and 141*ib*. Although a slight gap may be left between an upper end of each supply path 141*ia* and the filter 114*i*, it is preferable that the both be in abutment on each other in order to surely supply the ink up to the filter.

A posture of the liquid ejection head taken in use is illustrated in FIG. 4 and FIG. 5. The ink is drawn up to a height (La+Lb) of the second liquid chamber in this way with the aid of the capillary forces of the supply paths. Therefore, it is necessary to make the widths of the supply paths 141*ia* and 141*ib* sufficiently small as described later. It is preferable to make the (average) capillary force of the supply path 141*ia* larger than the (average) capillary force of the supply path 141*ib* in order to further surely draw the ink up to the filter 114*i* in this way.

In addition, the supply paths 141*ia* and 141*ib* are made mutually different in width with the bent part 142 being set as a boundary. A width W1 of a part (the upstream-side end of the supply path 141*ia*) of the supply path 141*ia* which almost abuts on the filter 114*i* is smaller than a width W3 of the supply path 141*ib* on the ejection element substrate 155*c* side (the downstream side of the supply path 141*ia*).

In the present embodiment, the width of the supply path 141*ia* located at a higher position in a vertical direction of the second liquid chamber 122*i* is made narrower than that of the supply path 141*ib* located at a lower position in the vertical direction of the second liquid chamber 122*i* in the posture taken in use in this way so as to make the supply path 141*ia* have the stronger capillary force. In addition, since the supply path 141*ib* is connected with the supply path 141*ia* at the bent part 142, the ink which has been drawn up with the aid of the capillary force of the supply path 141*ib* is then further drawn up with the aid of the stronger capillary force of the supply path 141*ia* at the bent part 142.

In addition, as described above, the housing 111 is configured by the molded component and the second liquid chamber 122 is formed by removing the die upward in FIG. 5 and FIG. 7 after molding. Therefore, the draft angle for assisting in removing the die upward is provided to each part. The draft angles are also provided to the ribs 143*ia* and 143*ib* so as to configure that a root-side width W2 of the supply path 141*ia* is made smaller than the leading-end-side width W1 of the supply path 141*ia* and a root-side width W4 of the supply path 141*ib* is made smaller than the leading-end-side width W3 of the supply path 141*ib*. That is, W1>W2 and W3>W4 and the width of the flow passage is gradually increased relative to an ink flowing direction in each supply path.

In a case where supply characteristics of the ink are taken into consideration, it is preferable that the width of the flow passage be gradually reduced relative to the ink flowing direction. However, stable ink supply becomes possible by making the width of each supply path sufficiently small and by dividing one supply path into the plurality of paths as in the present embodiment. That is, it becomes possible to suppress influence of the draft angle of the die by dividing the supply path into the plurality of paths and thereby making the length of each supply path short.

In the present embodiment, the draft angle of the second liquid chamber 122*i* is uniformly set to 0.5 degrees, the width W1 is set to 0.30 mm and the width W3 is set to 0.53 mm. In addition, since the length La of the rib 143*ia* in a die removing direction is set to 6.90 mm and the length Lb of the rib 143*ib* in the die removing direction is set to 4.26 mm, the width W2 of the supply path 141*ia* will be about 0.23 mm and the width W4 of the supply path 141*ib* will be about 0.45 mm.

As described above, the supply paths 141*ia* and 141*ib* are formed by the ribs 143*ia* and 143*ib* and are respectively configured such that the width of the supply path 141*ib* becomes wider than that of the supply path 141*ia* with the bent part 142*i* being set as the boundary. The widths of the supply paths 141*ia* and 141*ib* are gradually reduced respectively from the widths W1 and W3 on the leading-end sides (the front sides in the die removing direction) respectively toward the widths W2 and W4 on the root sides (the back sides in the die removing direction) by providing the draft angles.

The draft angle forms an inclined surface. Therefore, in a case where the length of the supply path is increased in an existing configuration, the width of the supply path is narrowed too much and it becomes difficult to configure the supply path. In contrast, it becomes possible to arrange the supply path 141 (141*ia*, 141*ib*) over a long length after the draft angle is provided to the supply path 141 (141*ia*, 141*ib*), by providing the bent part 142 and changing the width of the supply path 141 (141*ia*, 141*ib*) with the bent part 142 being set as the boundary as in the present embodiment. That is, it is possible to draw the ink up to the filter 114*i* located at a high position in a gravity direction while suppressing the influence of the draft angle of the die by changing the width of the supply path at a joint between the supply paths 141*ia* and 141*ib* so as to be W2<W3.

Thereby, it becomes possible to optionally make the width of the supply path 141 narrow and it becomes possible to configure the second liquid chamber 122 large in the height direction. It becomes possible to retain more air bubbles under the filter by configuring the second liquid chamber 122 large in the height direction and high-speed printing becomes possible by arranging a large number of the ejection ports (increasing a length of an array of the ejection ports). Further, since the capacity of the liquid chamber is increased in the height direction, it is possible to reduce the number of the recovering operations and therefore it is possible to reduce an amount of ink to be discharged.

Incidentally, although in the present embodiment, the supply path which is concave in section has been provided, the supply path is not limited to the above-mentioned configuration and may have a V-shaped section.

In addition, although in the present embodiment, the supply path 141*ib* is configured to include the vertical part and the horizontal part, the supply path 141*ib* is not limited to the above-mentioned one and may be obliquely inclined.

In addition, although in the present embodiment, one bent part 142 is provided and the width of the supply path is changed with the bent part 142 being set as the boundary, the supply path is not limited to this and may be configured such that the plurality of bent parts is provided and the width of the supply path may be changed at every bent part. Incidentally, on that occasion, the supply path is configured such that the supply path located at a lower position in the vertical direction has a wider width.

In addition, in the present embodiment, the supply path 141*ia* and the supply path 141*ib* are favorable for a configuration that the supply paths are connected together at the bent part. In the present invention, "bending" is applicable not only to the configuration that the supply path is bent almost at right angles as in the above-mentioned embodiment but also to a curved supply path.

Incidentally, although the example that the widths of the respective supply paths are defined has been described as in the above-mentioned embodiment, the present invention is not limited to the configuration described in the example and for example, flow passage sectional areas of the supply path 141*ia* and the supply path 141*ib* may be defined.

The liquid chamber which is formed in a part of the flow passage that guides the liquid to the ejection element substrate includes the plural supply paths which are able to supply the liquid with the aid of the capillarity, are connected together and are made different from one another in width in this way. Thereby, it becomes possible to realize the liquid ejection head, the liquid ejection apparatus and the manufacturing method for the liquid ejection head capable of achieving both of the high-speed printing and the reduction in the number of recovering operations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-110246, filed May 29, 2015, which is hereby incorporated by reference herein in its entirety.

What is claimed is:

1. A liquid ejection head comprising:

an ejection element substrate configured to eject liquid;

a liquid chamber which is formed in a part of a flow passage that guides the liquid to the ejection element substrate;

a filter that divides the liquid chamber into a first liquid chamber on an upstream side and a second liquid chamber on a downstream side; and first and second supply paths formed by a plurality of ribs provided on an inner wall of the second liquid chamber, wherein the first supply path extends downward in a vertical direction from the filter in a posture at the time of use, and the second supply path communicates with the first supply path and extends in a direction crossing the vertical direction, and a capillary force of the first supply path is greater than a capillary force of the second supply path.

2. The liquid ejection head according to claim 1, wherein the first and second supply paths are different from one another in width and are connected together by being bent at a connection part.

3. The liquid ejection head according to claim 1, wherein the first and second supply paths each are formed in a state of being interposed between the ribs provided on the inner wall of the second liquid chamber.

4. The liquid ejection head according to claim 1, wherein one end of the first supply path which is located at the highest position in the vertical direction is in abutment on the filter in the posture at the time of use.

5. The liquid ejection head according to claim 1, wherein a draft angle for a die is provided to each of the first and second supply paths.

6. The liquid ejection head according to claim 1, wherein the first and second supply paths each are concave grooves.

7. The liquid ejection head according to claim 1, wherein a height of the second liquid chamber including the first supply path is higher than a height of the second liquid chamber including the second supply path.

* * * * *